US005536014A

United States Patent [19]

Serfozo

[11] Patent Number: 5,536,014

[45] Date of Patent: Jul. 16, 1996

[54] MODIFIED CHESS GAME

[76] Inventor: Andras Serfozo, 7301 W. University Ave. #56, Gainesville, Fla. 32607

[21] Appl. No.: 419,016

[22] Filed: Apr. 10, 1995

[51] Int. Cl.[6] ..... A63F 3/02

[52] U.S. Cl. ..... 273/260

[58] Field of Search ..... 273/236, 242, 273/243, 248, 249, 260, 261

[56] References Cited

U.S. PATENT DOCUMENTS

| | | | |
|---|---|---|---|
| 3,761,093 | 9/1973 | Migliore | 273/260 |
| 5,197,742 | 3/1993 | Bendit | 273/260 X |
| 5,228,699 | 7/1993 | Ludwick | 273/260 |

FOREIGN PATENT DOCUMENTS

| | | | |
|---|---|---|---|
| 2617053 | 12/1988 | France | 273/260 |
| 1703150 | 1/1992 | U.S.S.R. | 273/260 |

*Primary Examiner*—William E. Stoll

[57] ABSTRACT

A technique for playing a modified chess game on a modified board, having a foremost playing area of eight square by eight square rows and plurality of marks printed on top of the board. The board possesses alternately colored red and white squares comprising a plurality of strategically placed green diamonds. The game having two sets of conventional chess pieces, differentiated by color. Each set comprising of 16 pieces, one set red the other white. The pieces are set up and move in a traditional chess manner. In addition when any royalty step on one of the squares marked with green diamond the player has to convert the royalties traditional movement to a specified move. As for the Queen and Knights the specified move is a single move, while for the King, Bishops, and Rooks is plural. In the case of a plurality the decision are always optional to the players. The object of the game is to position your pieces so your next move would capture the opponent's King and your opponent cannot move the King or any other pieces to protect the King or capture your piece. This is called checkmate.

2 Claims, 8 Drawing Sheets

MODIFIED CHESS GAME

BACKGROUND OF THE INVENTION

Altered chess game; The invention is a modification to the conventional game of chess.

DESCRIPTION OF PRIOR ART

The conventional game of chess has been with us for hundreds of years and is internationally acknowledged as a pleasure time activity as well as organized sport. After many years, conventional chess being the workhorse for challenging minds, it starts to show its age and lack of endeavor due to the fact that it has aged and weary rules. Here lies the need to intensify the game and bring it to new heights. Although several inventor tried such as:

Isaac, U.S. Pat. No. 3,844,563. Date: Oct. 29, 1977. discloses Chess Type Game With Changeable Board Indica.

Castellano, U.S. Pat. No. 3,433,482. Date: Mar. 18, 1969. discloses Chess Game Apparatus With Changeable Board.

Riihilouma, U.S. Pat. No. 4,927,157. Date: May. 22, 1990. discloses Chess Like Board Game Apparatus And Method Of Playing The Same.

Hoerbelt, U.S. Pat. No. 4,991,856. Date: Feb. 12, 1991. discloses Circular Chess Game Board.

With all do respect unfortunately all of them suffer from the same disadvantages, leaving the players with complexity and difficulty to re learn and play the game on a very time consuming way.

SUMMARY OF THE INVENTION

The present invention is a highly intellectual game, and can be played by either one or two players. It is a feature of the present invention to provide a unique game without having any violent characteristics. The cleverness and superiority of the present invention is in the flexibility and incorporation of the conventional rules with the novel rules. The invention includes a modified chess board and a unique novel rules whereby the present invention is an extremely rapid highly educational game. The invention also uses two sets of traditional chess pieces. Another feature of the invention is to provide a chess game which is simple to learn, yet trains the mind visualize and even use non-present pieces using hypothetical thinking. Another unique feature of the invention is the ability provided to players to change the royalties original moving ability to a novel movement raising individually each of their powers significantly.

DESCRIPTION OF THE PREFERRED EMBODIMENTS

Figure 1:
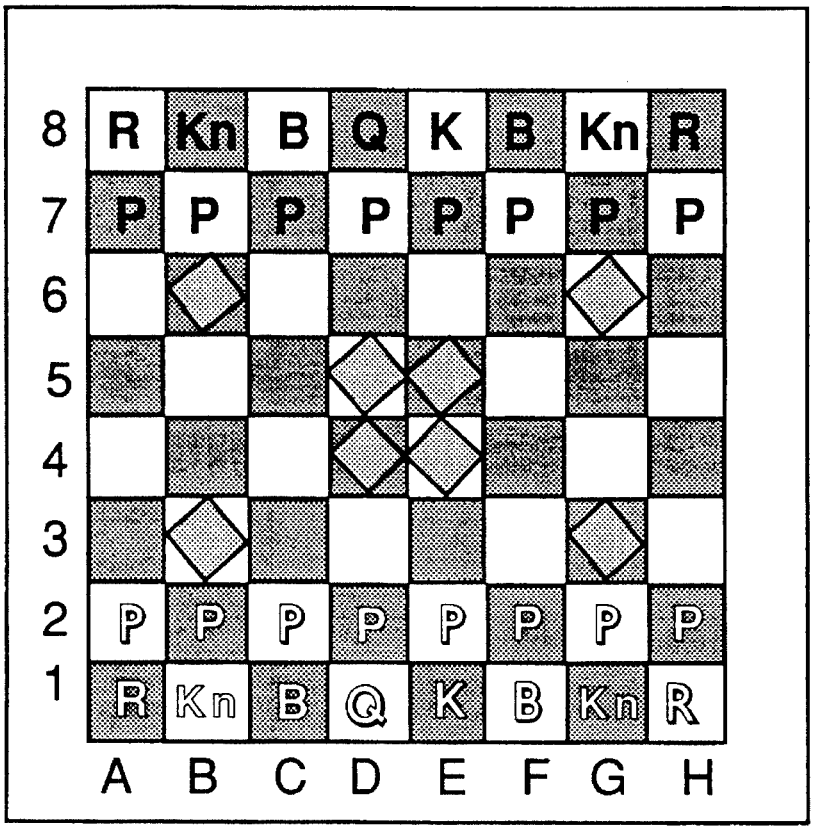
FIG. 1. is a top view of the modified game board with strategically placed diamond marks. The starting position of the playing pieces is also shown. One set White, identified and symbolized with outlined letters using the first letter of the name of the piece. The other set Red, identified and symbolized with bold typed letters and also using the first letter of the name of the piece. The only exception is the Knight, which is use the first two letters of its name for identification.
Figure 2:
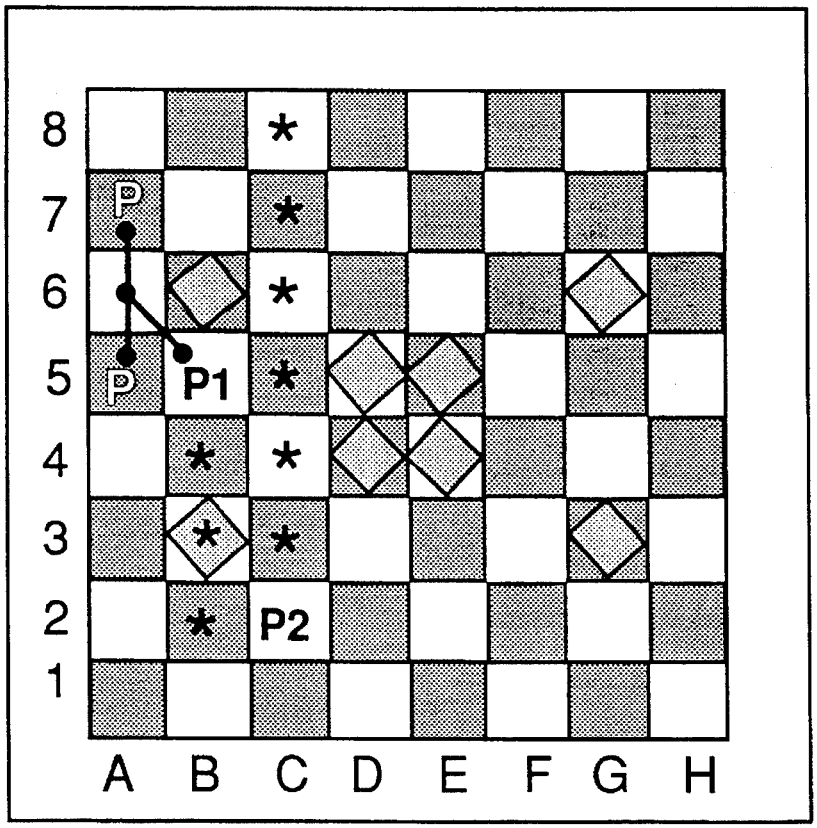
FIG. 2. shows the general movement of a Pawn—bold P2, straight cross the board, also En—Passant capturing. En—Passant capturing shows on FIG. 2, when your Pawn—bold P1 advanced for example from B-2, its starting position, to B-5, one square close to the opponent's Pawn—outlined P, which is still on it's starting position on A-7. Then when the opponent decides to move its Pawn two squares from A-7, to A-5, next to your Pawn, you have to capture it. Advance your Pawn one square behind it to A-6 and capture, even though the exact square A-5 where your opponent's Pawn is on, is not occupied by your Pawn. Always move the captured piece off the board.
Figure 3A:
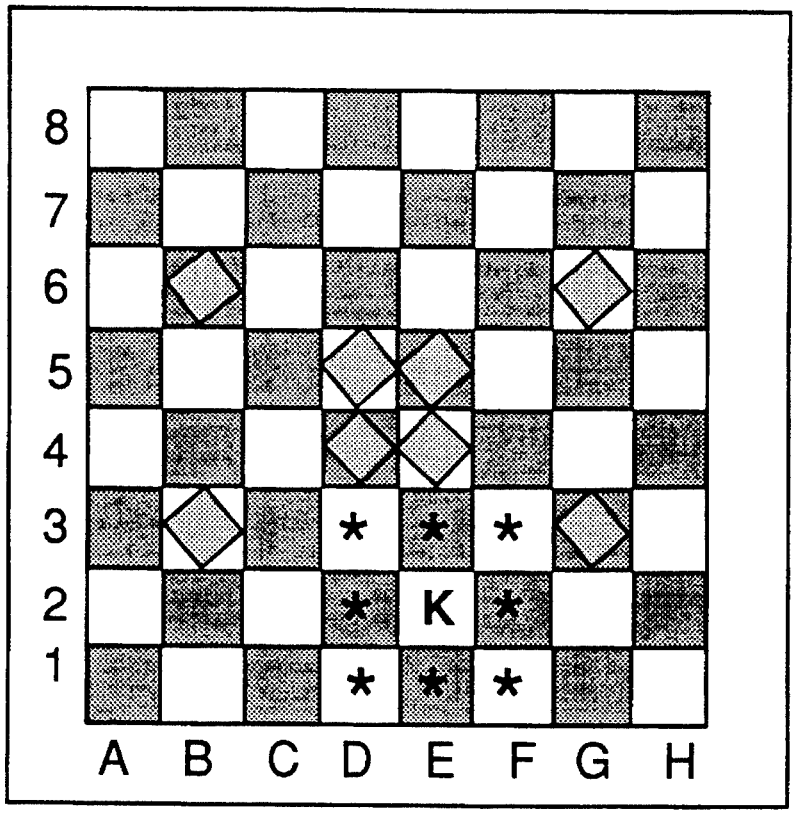
FIG. 3*a*. shows the general movement of a King.
Figure 3B:
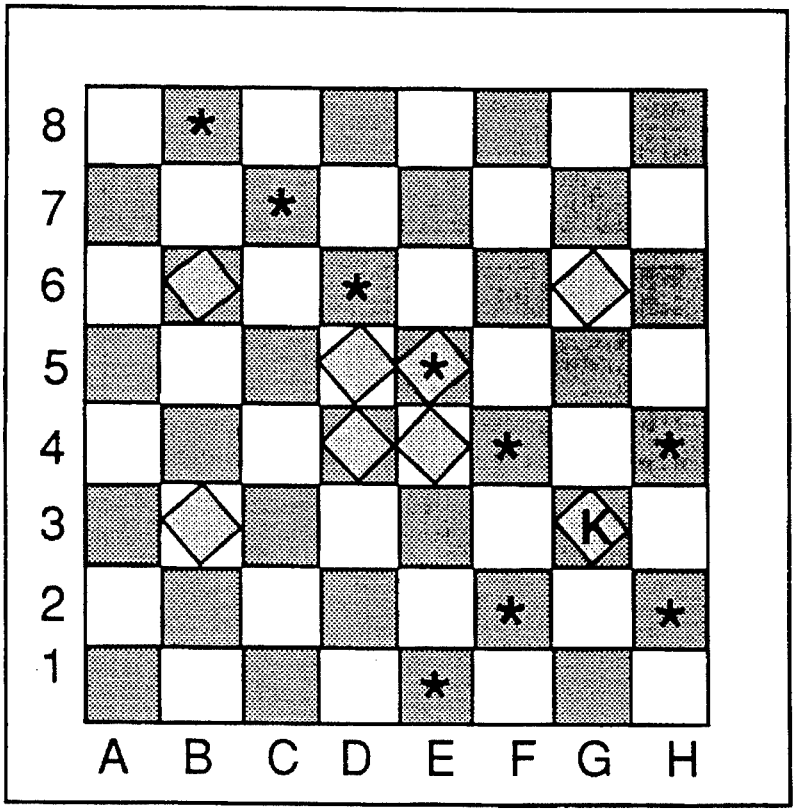
FIG. 3*b*. shows the movement of a King from a marked square as a Bishop, or see FIG. 3*c*.
Figure 3C:
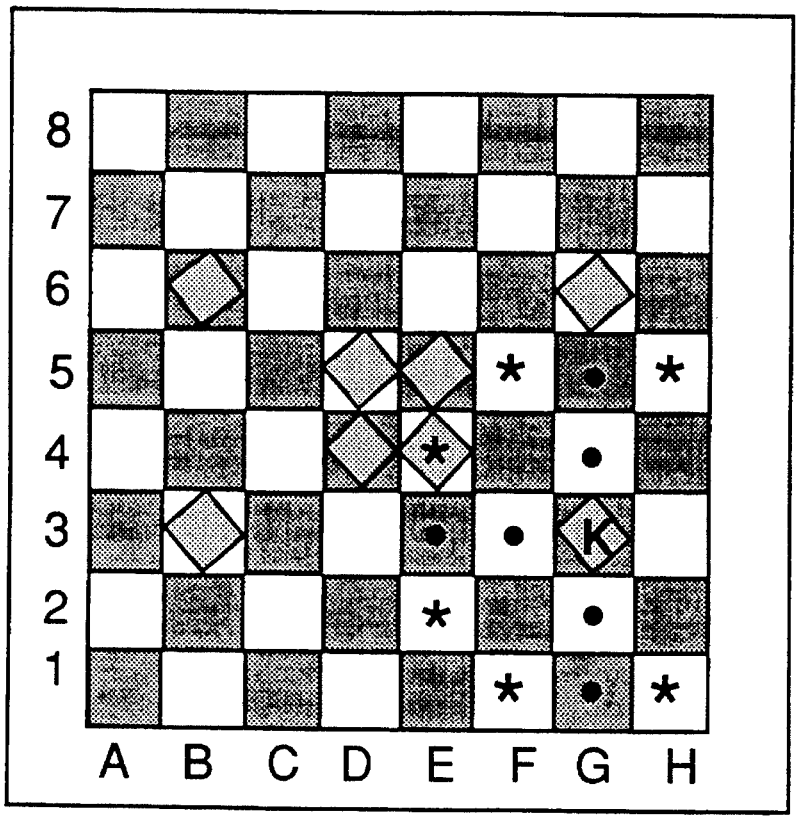
FIG. 3*c*. shows the movement of a King from a marked square as a Knight.
Figure 4A:
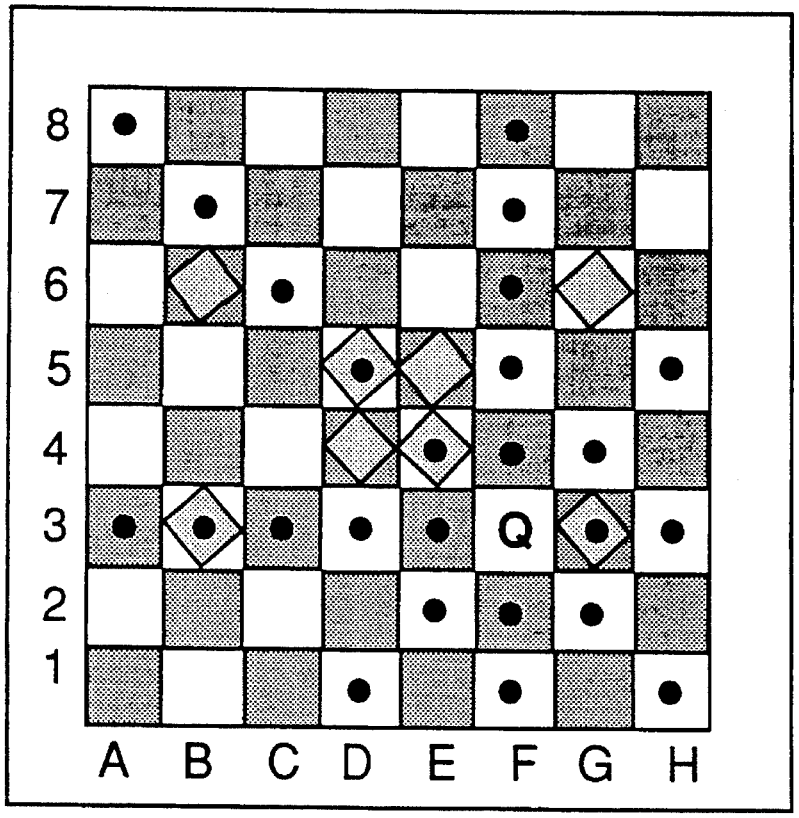
FIG. 4*a*. shows the general movement of a Queen.
Figure 4B:
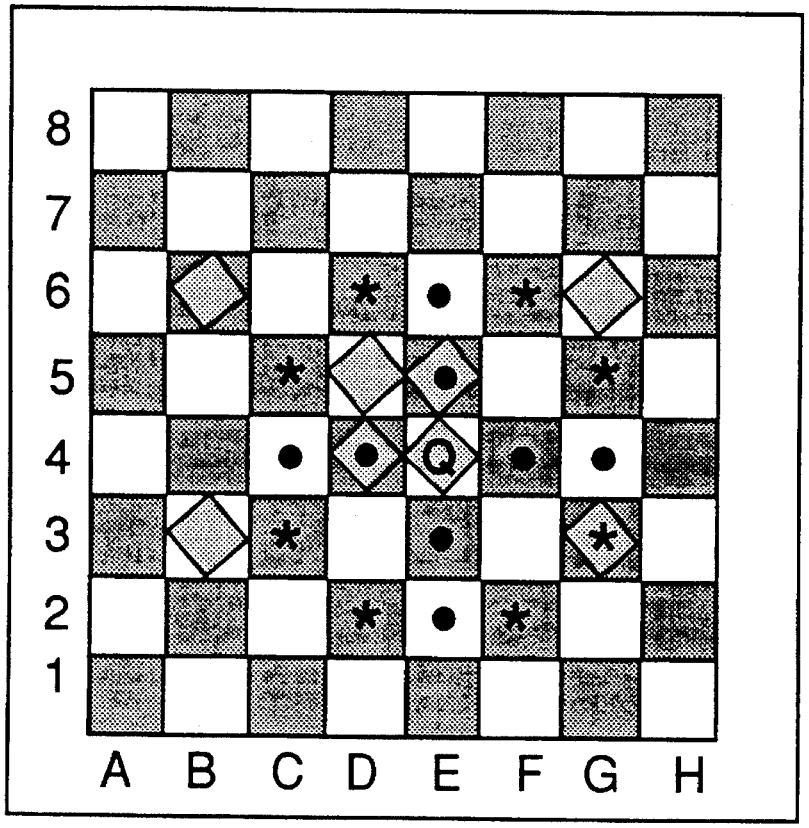
FIG. 4*b*. shows the movement of a Queen from a marked square as a Knight.
Figure 5A:
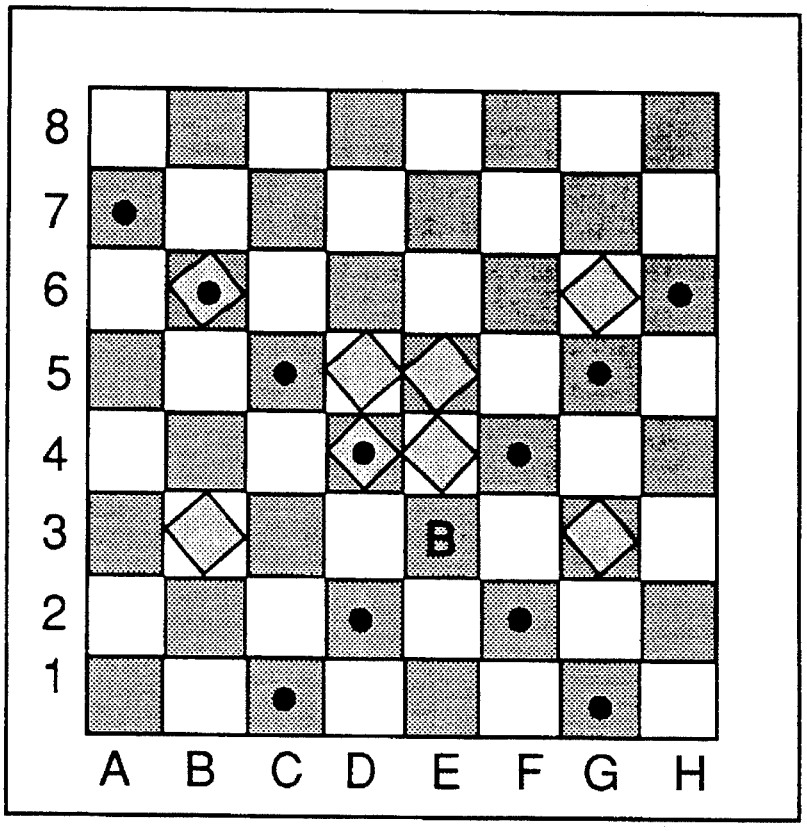
FIG. 5*a*. shows the general movement of a Bishop.
Figure 5B:
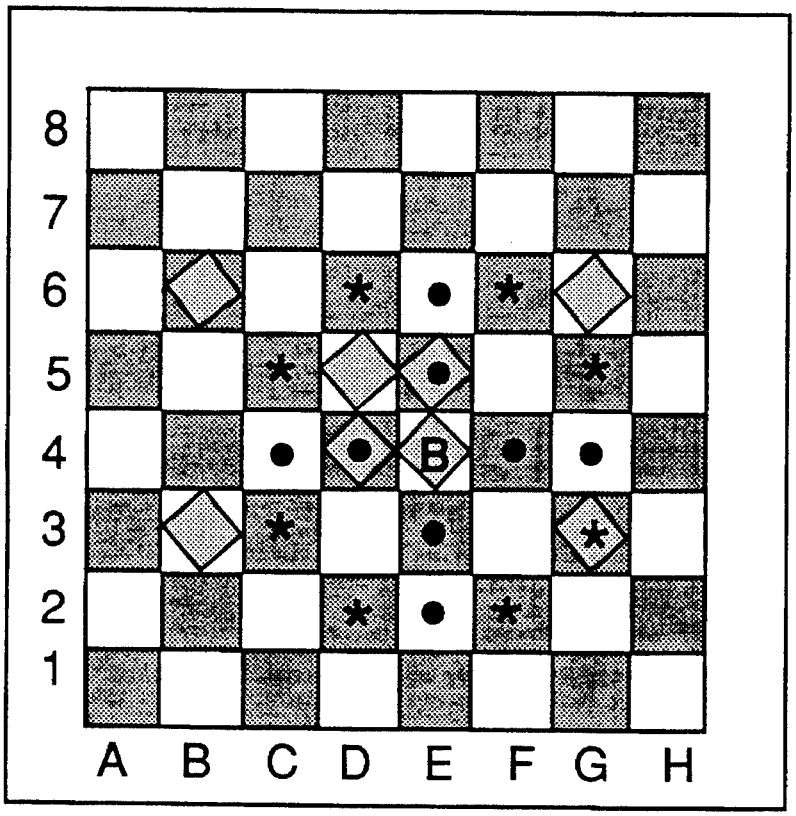
FIG. 5*b*. shows the movement of a Bishop from a marked square as a Knight, or see FIG. 5*c*.
Figure 5C:
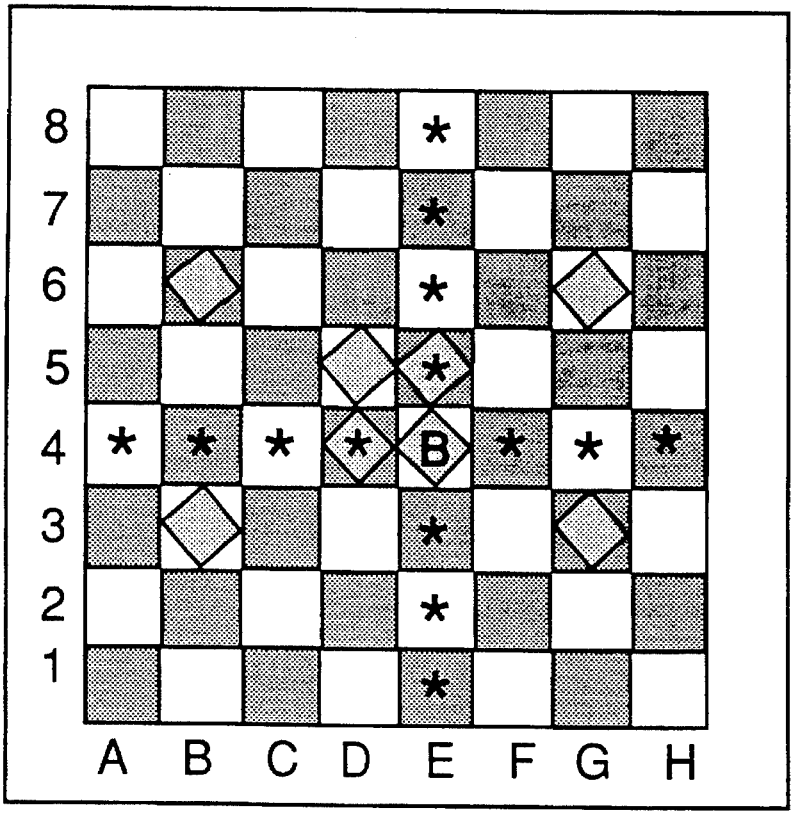
FIG. 5*c*. shows the movement of a Bishop from a marked square as a Rook.
Figure 6A:
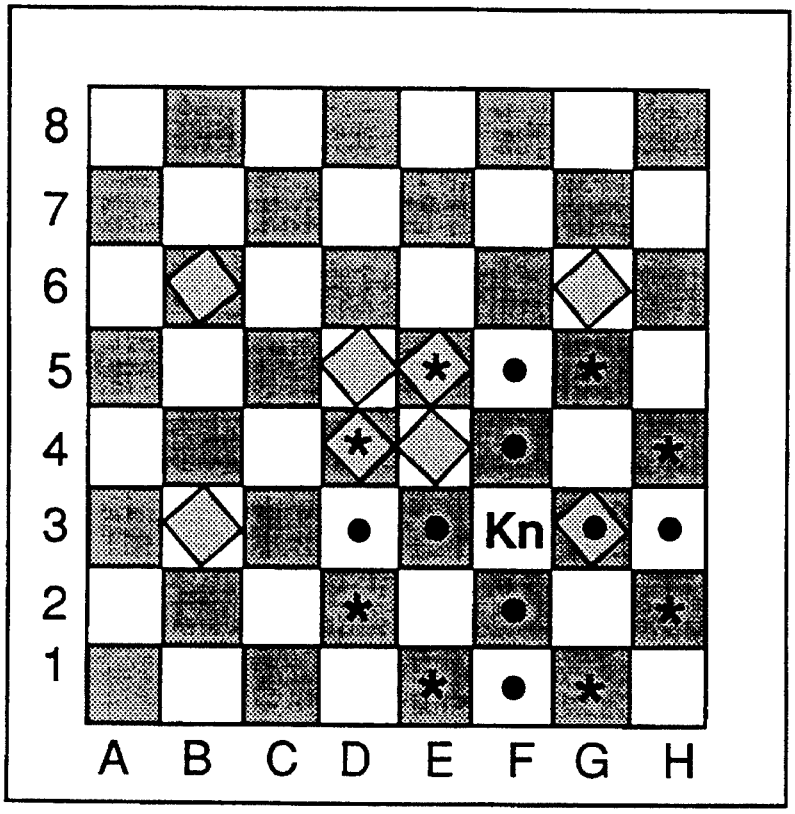
FIG. 6*a*. shows the general movement of the Knight.
Figure 6B:
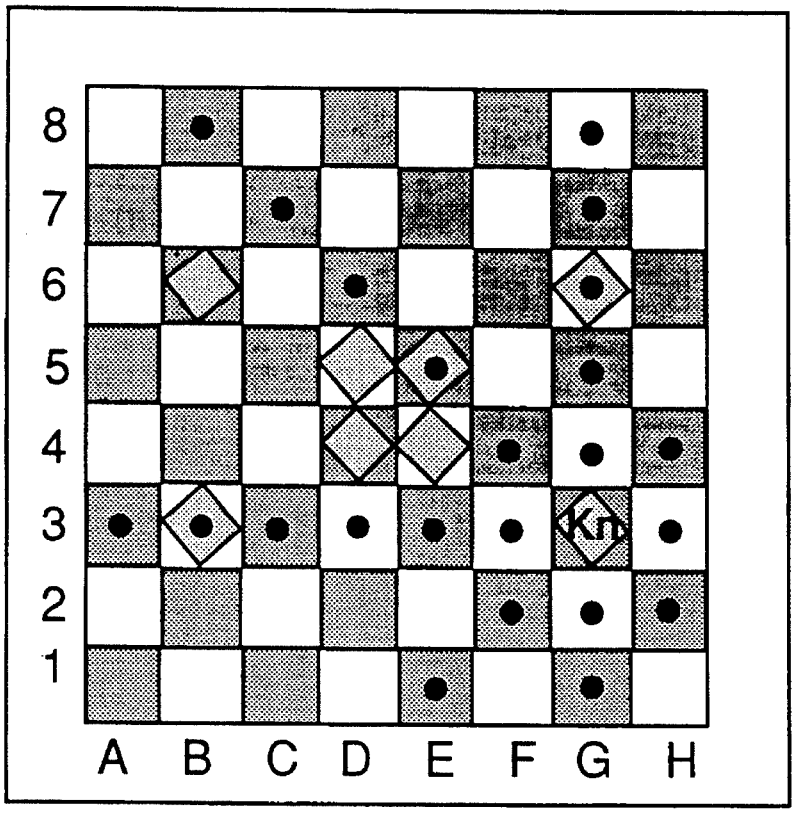
FIG. 6*b*. shows the movement of a Knight from a marked square as a Queen.
Figure 7A:
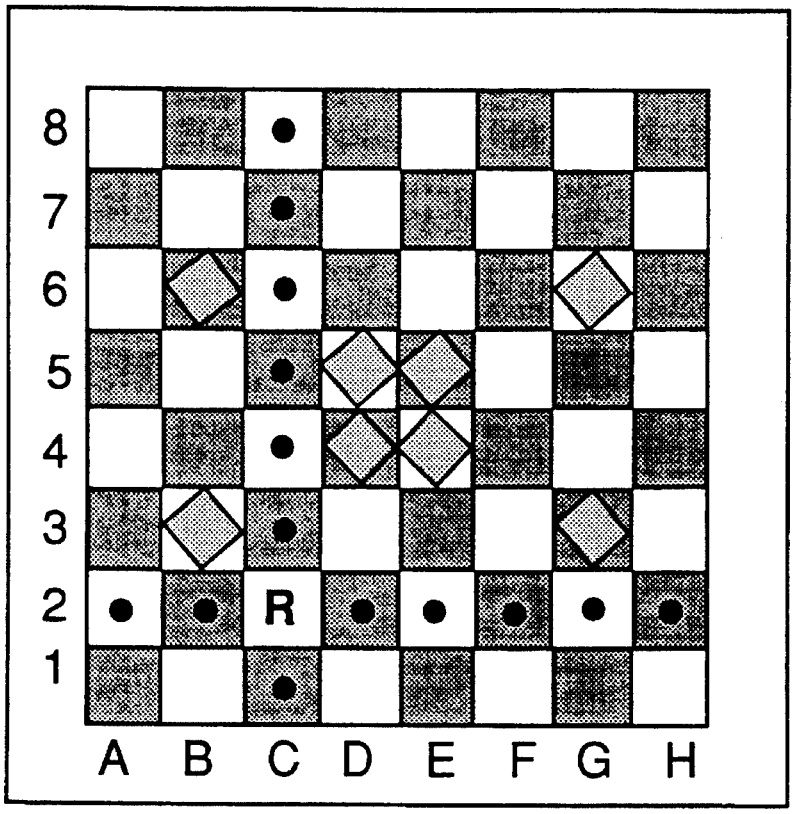
FIG. 7*a*. shows the general movement of a Rook.
Figure 7B:
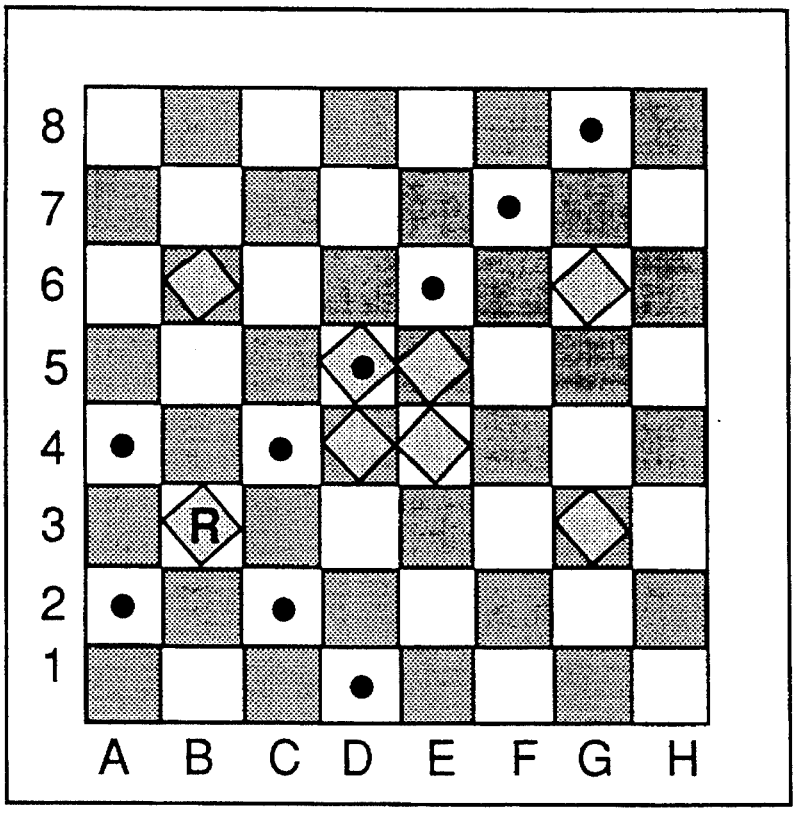
FIG. 7*b*. shows the movement of a Rook from a marked square as a Bishop, or see FIG. 7*c*.
Figure 7C:
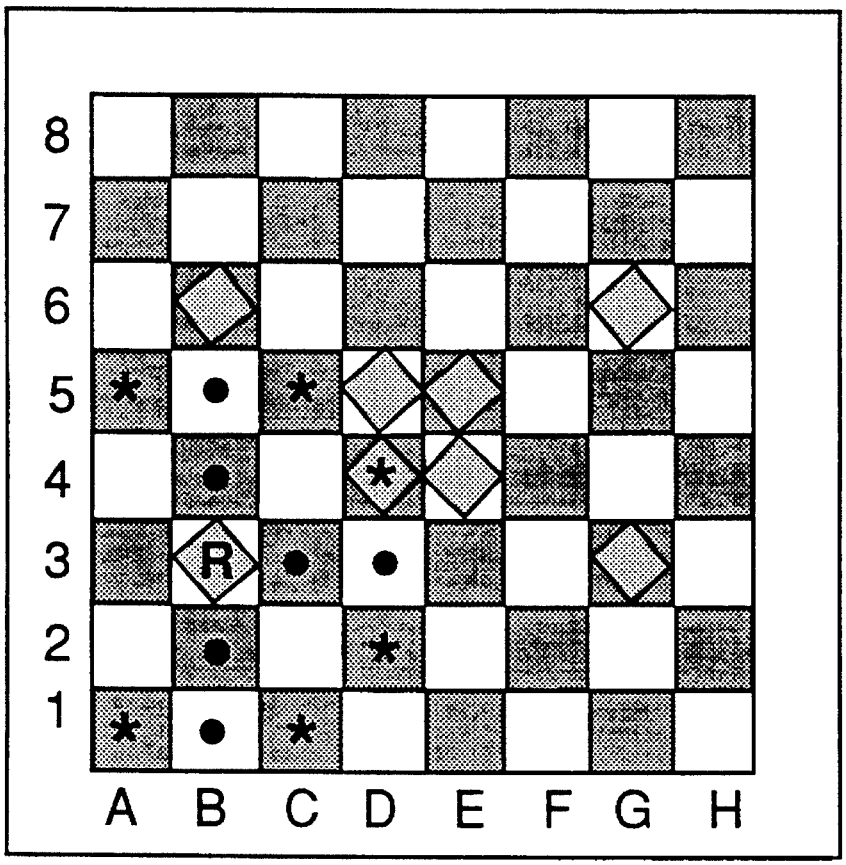
FIG. 7*c*. shows the movement of a Rook from a marked square as a Knight.

The preferred embodiments of modified chess game, named herein: ULTI-MATE CHESS will be described in detail. The game of the present invention can be played by one or two players capable of learn and understand simple traditional chess rules and comprehending the concepts of the novel rules of the game. It should be admired that the invention is designed to train the mind to accept and use two of the most difficult tasks namely: visualizing nonpresent things as well as using hypothetical thinking. As will be explained in more detail the game of the present invention also requires the use of equipment.

Said equipment is a modified chess board which includes eight vertical rows called upright, and eight horizontal rows called levels. Each level, bottom to top, is designated by number 1 through 8, and consists of eight squares alternately colored. Each upright left to right, is designated by letter of the alphabet A through H, and consists of eight squares alternately colored Said modified chess board further comprising a plurality of diamond marks. Said diamond marks are strategically placed and are an indicator to the players that they have to alter the movement of the royalties. Those of ordinary skill in the art will recognize that the shape of the marking need not be a diamond, but may be any shape recognizable to indicate that the marked square has the property of altering the movement of a royalty which lands here on. Also recognizable that those marks may be placed on the board in any other location in any other number. The reason to place them in the number and in the strategic pattern as it is that none of the players can get on it immediately from one move and gain advantages over the other. Therefore the game is well balanced and strategically have superiority over any other pattern.

Said modified chess board is set for the game properly when the left hand bottom squares are red or otherwise shaded from the view of each player.

The game also requires the use of a total of 32 traditional chess pieces Said chess pieces are a King, a Queen, two Bishops, two Knights, two Rooks, all called royalties, and eight Pawns representing one team. The same number of royalties and Pawns represent the other team.

It is recognizable that the present invention can be adopted to computerized version, also in 3-D. It should be understood that the examples and embodiments described herein are for illustrative purposes only and that various modifications or changes in light therefore will be suggested to persons skilled in the art and are to be included within the spirit and purview of this application and the scope of the appended claims. Herein incorporated by references:

Hegener, U.S. Pat. No. 5,098,106. Date: Mar. 24, 1992. discloses Chess Teaching Computer.

Hollander, Howden, Jones, Killinger, Knighton, Sims, U.S. Pat. No. 4,398,720. Date: Aug. 16, 1983. discloses Robot Computer Chess Game.

Dudley, U.S. Pat. No. 4,391,447. Date: Jul. 5, 1983. discloses Electronic Chess Game.

THE GAME RULES

The game begins with each player setting up the playing pieces in a manner of the traditional chess game. The basic rules and moves are the same as the conventional chess game until any royalty steps onto any marked square on the board. From a marked square the player has to change the movement of the royalty. Once the royalty steps back onto an unmarked square on the board it will be automatically converted back to its traditional chess moving abilities. The whole conversion to altered and back to conventional movement will be done in the players mind. Since the conversion is actually temporary the players visualize in their mind nonpresent pieces rather than exchanging them. Additional rules are as defined in conventional chess those includes:

Check: check occur's when a player's pieces directly threatens to capture the opponent's King, but the opponent can move the King or other piece to escape capture.

Capturing: to capture a piece, you move your piece into the square occupied by the opponent's piece, except when capturing an opponent's Pawn En—Passant, always remove the captured piece from the game board.

Castling: castling protects the King from a potential check or checkmate situation by hiding him behind a fortified position. You may castle if the following four condition exist:

1. The King has not moved from its original position.
2. The King is not placed in check on its current square, the square to which it is going, or the square it passes over.
3. The Rook which you want to move by castling has not moved from its original position.
4. The squares between the King and Rook are not occupied. In castling, the King moves two squares in the direction of either Rook. The chosen Rook in castling moves to occupy a square next to and on the other side of the King. Castling counts as one move.

Additional rules which is different as in conventional chess but standard in present invention those includes:

Capturing En—Passant: a Pawn can capture an opponent's Pawn which has just moved two squares from its starting position. En—Passant capturing has to be done in the present invention, it is not a subject of desire, with one exception. When your En—Passant capturing would place your own King into check the capturing cannot be done.

Promoting Pawn: when a Pawn crosses the entire board it may be promoted to any rank of royalty, but only if the chosen royalty has been captured and is out of the game. If all royalties are still in the game your Pawn cannot be promoted. It would stay on the square until it becomes captured, or until you loose one of your royalty then that Pawn can be promoted to the lost rank of royalty.

Stalemate rules: the game most end by stalemate when:

(a) each player has only their King on the board and both Kings end up on a marked square, or both Kings and up on an unmarked square.

(b) When a King cannot move anywhere without being captured and it is not in check, and other piece on the board can move.

(c) When the attacking player is unable to force the opponent's only piece (King) on the board into a checkmate within 21 steps.

MOVEMENT OF THE PIECES INDIVIDUALLY

A Pawn can move only one square forward except from its starting position when it can move two squares. Said Pawn always captures diagonally and never moves backward. Said Pawn further is not regulated by the diamond marks.

A King can move only one square vertically, horizontally or diagonally from any unmarked squares. When said King steps on any diamond marked square it has to move either as a Bishop, moving any number of squares diagonally, but not moving past a square occupied by another piece, or as a Knight, moving two squares vertically or horizontally then turning right or left and moving one additional square. Said King further can move through check but from a marked square only.

There had been a consideration of an idea to give more power to a King and allow it to move like a Rook which has been scraped The reason for it that it has a serious disadvantages. Whereas the King able to move through check the opponent would be unable to force a King with a moving power of a Rook into checkmate, therefore the game would never have a winner.

A Queen can move any number of squares vertically, horizontally or diagonally from any unmarked squares. Said Queen cannot pass a square occupied by another piece. When said Queen further steps on any diamond marked square, it has to move as a Knight, two squares vertically, or horizontally, then turning right or left and moving one additional square.

A Bishop can move any number of squares diagonally from any unmarked square. Said Bishop cannot move past a square occupied by another piece. When said Bishop further steps on any diamond marked square it has to move either as a Knight, two squares vertically, or horizontally then turning right or left and moving one additional square, or as a Rook moving any number of squares vertically or horizontally, but not moving past a square occupied by another piece. The marked square rules for a Bishop allows the players to change said Bishop's starting square color.

Consequently to have both Bishops on the same color and raise their power significantly.

A Knight can move from any unmarked square, two squares vertically or horizontally then turning right or left and moving one additional square. When said Knight further steps on any diamond marked square it has to move as a Queen, any number of squares vertically, horizontally, or diagonally, but not past squares occupied by another piece.

A Rook can move any number of squares vertically, or horizontally from any unmarked square. Said Rook cannot move past squares occupied by another piece. When said Rook further steps on any diamond marked square it has to move either as a Bishop any number of squares diagonally, but not past square occupied by another piece, or as a Knight two squares vertically or horizontally then turning right or left and moving one additional square.

When the movement is multiple from the marked square the decision always optional to the players. Said player does not have to verbally inform the opponent about the decision it will become clear once the movement has been made.

I claim as my invention:

1. A method of playing a modified chess game comprising:

a. Using a modified chess board representing a playing field and comprised of a plurality of vertical rows called upright and a plurality of horizontal rows called level said upright left to right designated by letters of the alphabet and said level bottom to top designated by numbers said upright and level squares further being alternately colored said modification comprising placing a plurality of marks strategically upon the top of the board said marks acting as the indicators to alter the royalties various movement, and b. Using two sets of recognizable conventionally shaped chess pieces differentiated by colors one set of said chess pieces includes a king, a queen, two bishops, two knights, and two rooks, all called royalties, and eight pawns with the same number of royalties and pawns representing the second set each of said sets being appointed to each player said players placing their own pieces in traditional manner onto the board said players further moving in turn one of their pieces according to its moving ability and varying each royalties movement when said royalty lands on a marked square.

2. A technique of playing a modified chess game comprising:

a. A modified chess board representing a playing field and comprised of a plurality of vertical rows called upright and a plurality of horizontal rows called level said upright left to right designated by letters of the alphabet and includes a plurality of squares, said level bottom to top designated by numbers and includes a plurality of squares, said upright and level squares further are alternately colored, the modified chess board further comprising a plurality of marks placed strategically upon the top of the board said marks further are the indicators to utilize the royalties various movements;

b. Two sets of recognizable conventionally shaped chess pieces differentiated by colors one set of said chess pieces includes a king, a queen, two bishops, two knights, two rooks, all called royalties, and eight pawns with the same number of royalties and pawns representing the second set, after appointing said sets to each player, said players rank their own pieces in traditional chess manner onto the board, said players further moving in turn one of their pieces according to its moving ability; and c. In addition a novelty of rules are provided for the motion of the playing pieces;

wherein when a king steps on any of said marks it has to move either as a bishop or as a knight said king further can move through check but from said marks only;

wherein when a queen steps on any of said marks it has to move as a knight;

wherein when a bishop steps on any of said marks it has to move either as a knight or as a rook;

wherein when a knight steps on any of said marks it has to move as a queen; and wherein when a rook steps on any of said marks it has to move either as a bishop or as a knight.

* * * * *